US012269705B2

(12) United States Patent
Mochizuki

(10) Patent No.: US 12,269,705 B2
(45) Date of Patent: Apr. 8, 2025

(54) CONVEYANCE CONTROL DEVICE AND CONVEYANCE CONTROL METHOD

(71) Applicant: Horizon Inc., Takashima (JP)

(72) Inventor: Jun Mochizuki, Shiga (JP)

(73) Assignee: Horizon Inc., Shiga (JP)

( * ) Notice: Subject to any disclaimer, the term of this patent is extended or adjusted under 35 U.S.C. 154(b) by 444 days.

(21) Appl. No.: 17/580,277

(22) Filed: Jan. 20, 2022

(65) Prior Publication Data

US 2022/0234854 A1 Jul. 28, 2022

(30) Foreign Application Priority Data

Jan. 22, 2021 (JP) ..... 2021-008830

(51) Int. Cl.
*B65H 7/04* (2006.01)
*B65H 7/02* (2006.01)
(Continued)

(52) U.S. Cl.
CPC ..... *B65H 7/04* (2013.01); *B65H 7/02* (2013.01); *B65H 7/20* (2013.01); *B65H 29/18* (2013.01);
(Continued)

(58) Field of Classification Search
CPC .. B65H 7/20; B65H 2513/50; B65H 2801/24; B65H 2801/48; B65H 7/04; B65H 2513/51; B65H 2557/61; B65H 2601/12
See application file for complete search history.

(56) References Cited

U.S. PATENT DOCUMENTS 6,338,479 B1 * 1/2002 Van Der Werff ..... B65H 83/02 271/69

FOREIGN PATENT DOCUMENTS

| | | |
|---|---|---|
| EP | 3 967 638 A1 | 3/2022 |
| JP | 2001-019261 A | 1/2001 |
| JP | 201434132 A | 2/2014 |

OTHER PUBLICATIONS

Extended European Search Report for European Application No. 22152083.6 dated Jun. 24, 2022.
(Continued)

*Primary Examiner* — Jeremy R Severson
(74) *Attorney, Agent, or Firm* — Muncy, Geissler, Olds & Lowe, P.C.

(57) ABSTRACT

A conveyance control unit is provided with a conveyance request unit configured to transmit a conveyance request signal to a paper conveyance device at a conveyance request timing corresponding to a processing cycle of a downstream paper processing device, a passage information reception unit configured to receive a paper passage signal indicating that paper has been sent out from the paper conveyance device, and the determination unit configured to determine whether a conveyance delay has occurred based on timing when the paper passage signal was received. The conveyance request unit is configured to transmit the conveyance request signal at the conveyance request timing corresponding to the next processing cycle when it is determined that a conveyance delay has not occurred, and the conveyance request unit is configured not to transmit the conveyance request signal at the conveyance request timing corresponding to the next processing cycle when it is determined that a conveyance delay has occurred.

17 Claims, 9 Drawing Sheets

(51) Int. Cl.

| | |
|---|---|
| ***B65H 7/20*** | (2006.01) |
| ***B65H 29/18*** | (2006.01) |
| ***B65H 43/00*** | (2006.01) |
| ***B65H 83/02*** | (2006.01) |

(52) U.S. Cl.
CPC ..... *B65H 43/00* (2013.01); *B65H 83/02* (2013.01); *B65H 2511/51* (2013.01); *B65H 2511/515* (2013.01); *B65H 2513/40* (2013.01); *B65H 2513/50* (2013.01); *B65H 2513/51* (2013.01); *B65H 2557/61* (2013.01); *B65H 2601/12* (2013.01); *B65H 2801/24* (2013.01); *B65H 2801/48* (2013.01)

(56) References Cited

OTHER PUBLICATIONS

Office Action for Japanese Patent Application 2021-008830 mailed Jul. 24, 2024.

* cited by examiner

CONVEYANCE CONTROL DEVICE AND CONVEYANCE CONTROL METHOD

CROSS-REFERENCE TO RELATED APPLICATIONS

This application claims priority to Japanese Patent Application No. 2021-008830 filed in Japan on Jan. 22, 2021, the contents of which are incorporated herein by reference in its entirety.

BACKGROUND

1. Technical Field

The present disclosure relates to a paper conveyance device for conveying paper ejected from an upstream paper processing device to a downstream paper processing device, and particularly relates to a conveyance control device and conveyance control method for controlling conveyance timing of paper.

2. Description of Related Art

Conventionally, a paper conveyance device is known for piling up one group of paper ejected from a printer and conveying the piled up paper bundle. For example, JP 2001-019261 A discloses a paper conveyance device provided with a paper piling unit for temporarily piling up paper ejected from a printer, wherein when paper sheets piled up in the paper piling unit reach a predetermined number to form a paper bundle, a dynamic belt is driven to eject the paper bundle from an ejection portion and convey it to a bookbinding machine to perform subsequent processing.

BRIEF SUMMARY

The paper conveyance device described in JP 2001-019261 A conveys a paper bundle to a bookbinding machine when paper sheets ejected from a printer are piled up to reach a predetermined number. Therefore, timing for conveyance depends on the printing speed of the printer, and it is necessary to adjust the timing of processing on the bookbinding machine side. Furthermore, because the processing speed of the bookbinding machine side depends on the printing speed of the printer, it is difficult to improve efficiency.

In light of the above, an object of the present disclosure is to provide a conveyance control device and a conveyance control method that can convey paper at an appropriate timing according to the processing cycle in a downstream paper processing device.

The first aspect of the present disclosure is a conveyance control device for controlling a paper conveyance request timing of a paper conveyance device for conveying paper ejected from a first paper processing device to a downstream second paper processing device, the conveyance control device including a conveyance request unit configured to transmit a conveyance request signal to the paper conveyance device at a conveyance request timing corresponding to a processing cycle of the second paper processing device, a passage information reception unit configured to receive a paper passage signal indicating that paper has been sent from the paper conveyance device, and a determination unit configured to determine whether there is a conveyance delay based on a reception timing of the paper passage signal, wherein the conveyance request unit is configured to transmit the conveyance request signal at the conveyance request timing corresponding to the next processing cycle when it is determined that a conveyance delay has not occurred, and the conveyance request unit is configured not to transmit the conveyance request signal at the conveyance request timing corresponding to the next processing cycle when it is determined that a conveyance delay has occurred.

The second aspect of the present disclosure is a conveyance control method for controlling a paper conveyance request timing of a paper conveyance device for conveying paper ejected from an upstream first paper processing device to a downstream second paper processing device, the method comprising transmitting a conveyance request signal to the paper conveyance device at a conveyance request timing corresponding to a processing cycle of the second paper processing device, receiving a paper passage signal indicating that paper has been sent from the paper conveyance device, determining whether there is a conveyance delay based on a reception timing of the paper passage signal, a step of transmitting the conveyance request signal at the conveyance request timing corresponding to the next processing cycle when it is determined that a conveyance delay has not occurred, and a step of not transmitting the conveyance request signal at the conveyance request timing corresponding to the next processing cycle when it is determined that a conveyance delay has occurred.

The third aspect of the present disclosure is a non-transitory computer readable storage medium storing a computer program for causing a computer to function as the conveyance control device.

The fourth aspect of the present disclosure is a paper processing device to which paper is supplied from a paper conveyance device, the paper processing device including the conveyance control device.

The fifth aspect of the present disclosure is a paper processing system including a paper conveyance device for conveying paper ejected from a first paper processing device, a second paper processing device to which paper is supplied from the paper conveyance device, and the conveyance control device.

The sixth aspect of the present disclosure is a paper conveyance device for conveying paper ejected from an upstream first paper processing device to a downstream second paper processing device, the paper conveyance device including a paper piling area where paper ejected from the first paper processing device is piled up, a sensor provided in a conveyance path for conveying paper from the paper piling area to the second paper processing device, the sensor detecting that the paper has passed, and a control device, wherein the control device conveys paper when a conveyance request signal is received, and the control device transmits a paper passage signal when passage of the paper is detected by the sensor.

According to the present disclosure, it is possible to bring about an effect of being able to convey paper at an appropriate timing according to a processing cycle in a downstream paper processing device.

DETAILED DESCRIPTION

One embodiment of the conveyance control device, a conveyance control method, and a program according to the present disclosure is described below with reference to the drawings.

Figure 1:
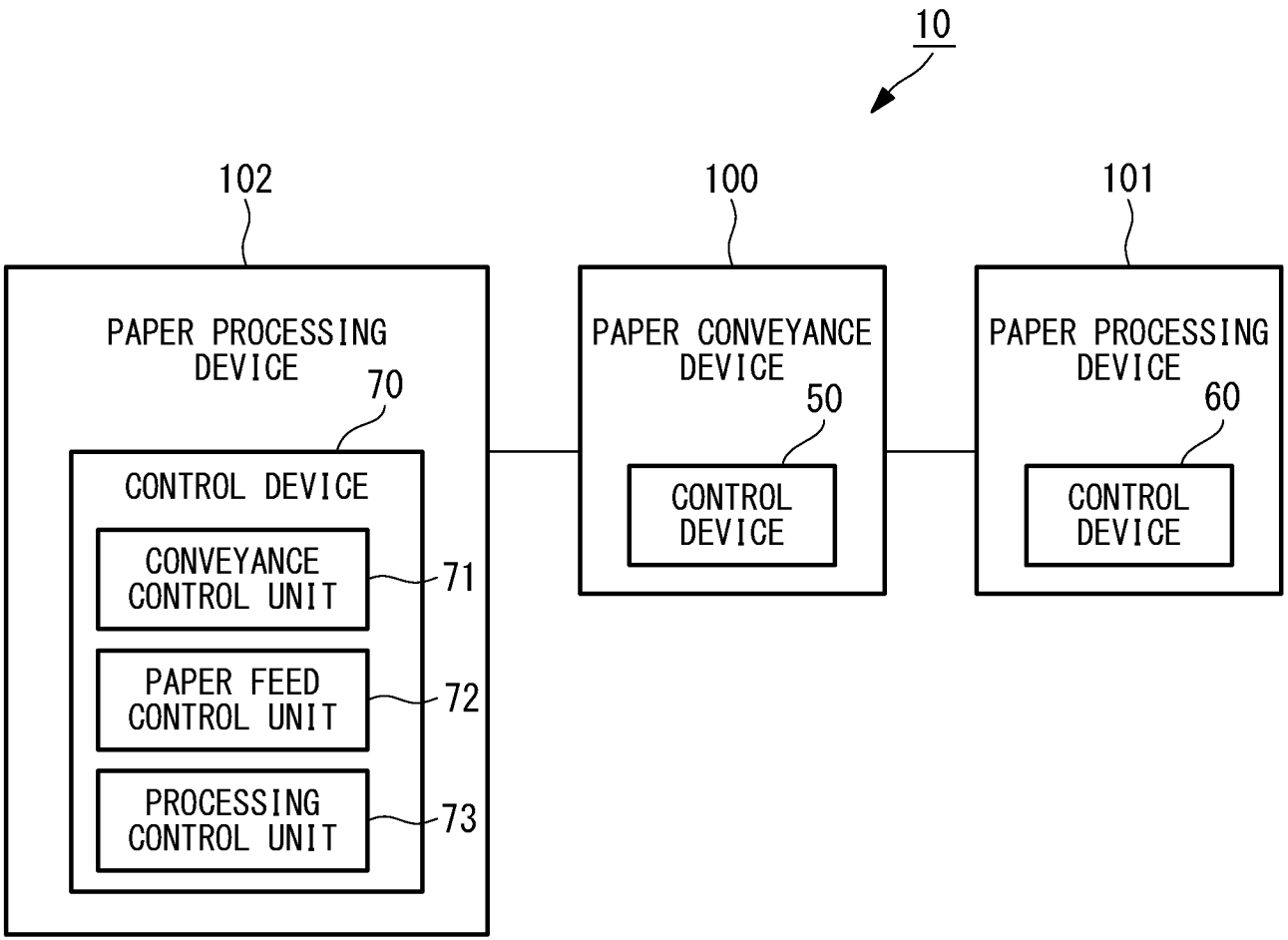
FIG. 1 is a function block diagram illustrating an overall schematic configuration of the paper processing system according to one embodiment of the present disclosure.
Figure 2:
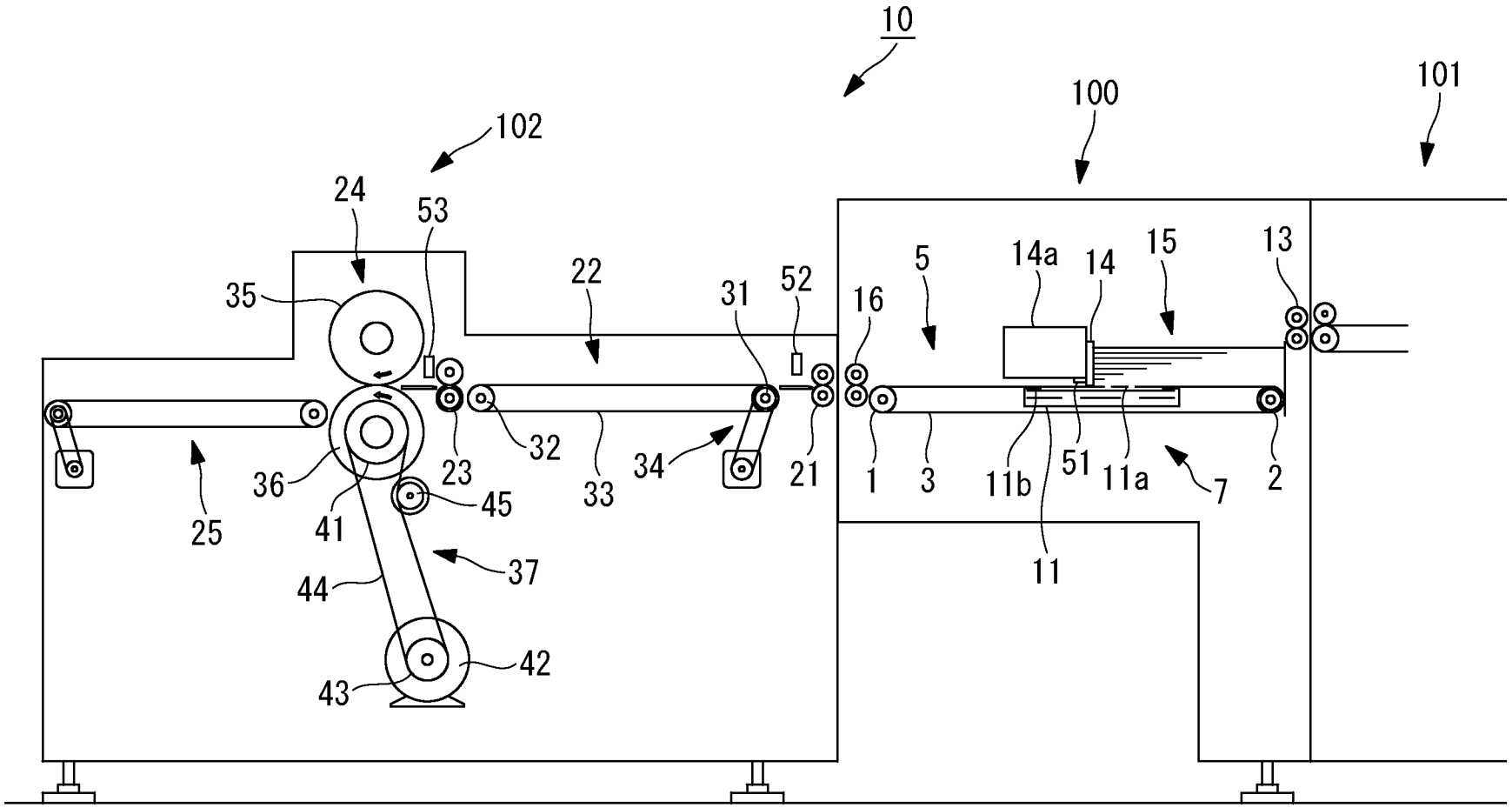
FIG. 2 is a schematic side view of the paper conveyance device and the paper processing device downstream according to one embodiment of the present disclosure.

FIG. 1 is a function block diagram illustrating an overall schematic configuration of a paper processing system 10 according to one embodiment of the present disclosure. As illustrated in FIG. 1, the paper processing system 10 is provided with a paper conveyance device 100, an upstream paper processing device (a first paper processing device) 101, and a downstream paper processing device (a second paper processing device) 102. The paper conveyance device 100, for example, is linked to the paper processing device 101 and the paper processing device 102 as illustrated in FIG. 2, which will be described hereafter.

The paper processing device 101 performs predetermined processing on paper, and ejects paper that has been processed to the paper conveyance device 100. Examples of the paper processing device 101 include a printer, an unwinder device having a cutting machine, and the like.

The paper conveyance device 100 temporarily piles up paper ejected from the paper processing device 101 and supplies the piled up paper sheets one at a time or at a predetermined number at a time to the downstream paper processing device 102. The paper processing device 102 receives the supply of paper from the paper conveyance device 100, performs predetermined processing on the paper, and ejects the processed paper. Examples of the paper processing device 102 include a rotating punching machine, a saddle stitching machine, a cutting device, and the like. For example, the paper processing device 102 is a device for continuously performing processing at predetermined cycles.

For example, the paper conveyance device 100 is provided with a control device 50, the paper processing device 101 is provided with a control device 60, and the paper processing device 102 is provided with a control device 70.

The control devices 50, 60, and 70, for example, may be connected via a common communication network and be configured to mutually give and receive information. Note that the method of connection for communication and communication protocol are not particularly limited. That is, in the present embodiment, at least the control device 60 and the control device 70 may be connected so that a series of processes described hereafter can be realized.

The control device 70 of the paper processing device 102 is provided with, for example, a conveyance control unit (conveyance control device) 71, a paper feed control unit 72, a processing control unit 73, and the like. Details of each of these control units will be described hereafter.

In the present embodiment, a case is given as an example wherein the control device 70 of the paper processing device 102 has the conveyance control unit 71 mounted thereon, but the present disclosure is not limited to this. For example, the conveyance control unit 71 may be separately disposed as an independent control device, may be mounted on an upper device such as the control device 70, and may be mounted on the control device 50. That is, the paper processing system 10 may have the overall function of the conveyance control unit 71, and the specific device for realizing this function is not particularly limited. For example, the control device 70 may have a portion of the functions of the conveyance control unit 71, and the control device 50 may have a portion of the functions of the conveyance control unit 71. Details of various processes executed by the conveyance control unit 71 and the like will be described hereafter.

Furthermore, the paper processing system 10 does not necessarily have to have the paper processing device 101 on the upstream side. For example, it may be configured such that paper processed by the upstream paper processing device 101 is installed in the paper piling area 15 (see FIG. 2) of the paper conveyance device 100 by a robot such as an automatic conveyance vehicle or a person.

Figure 3:
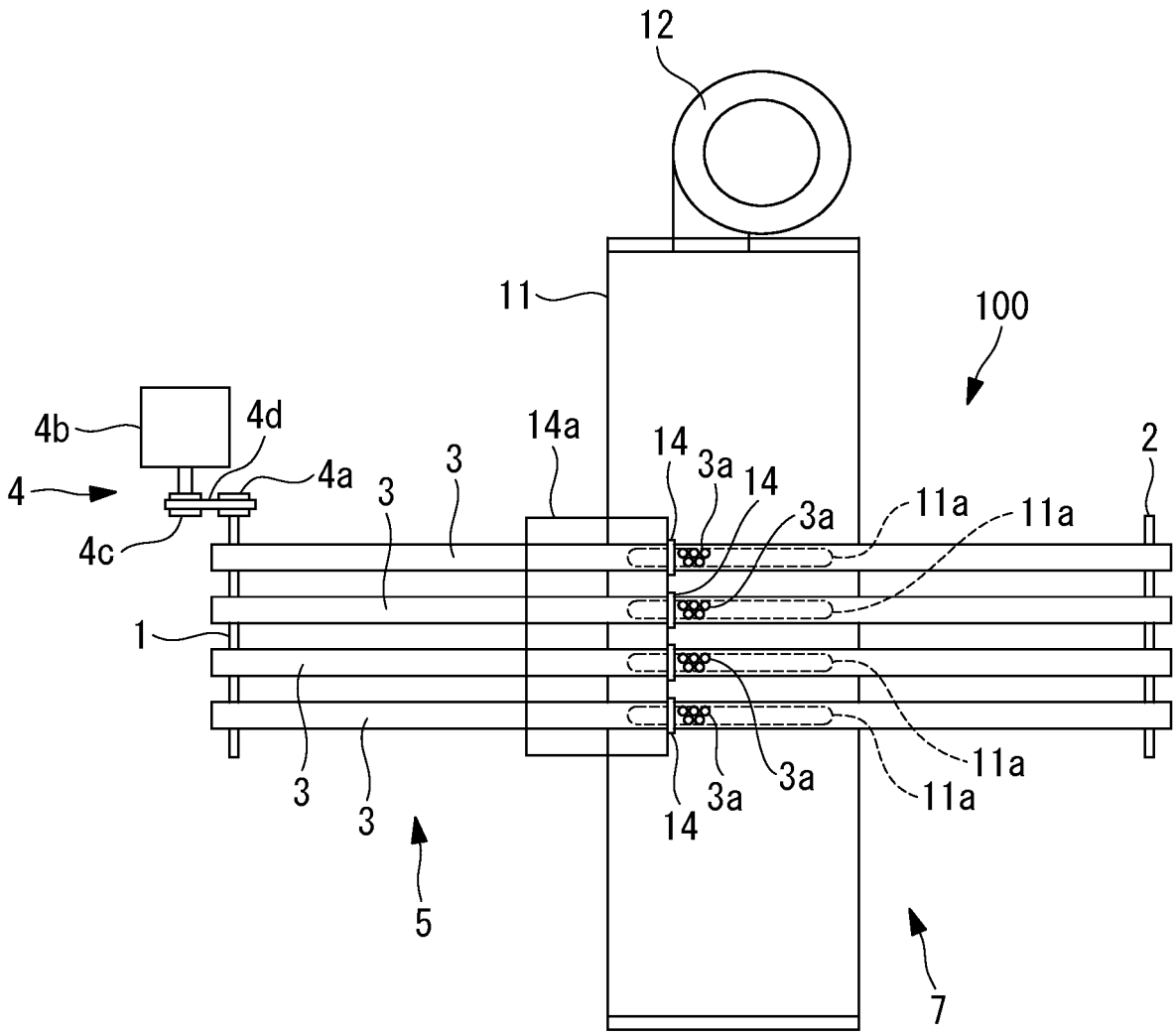
FIG. 3 is a schematic planar view of the paper conveyance device according to one embodiment of the present disclosure.

FIG. 2 is a schematic side view of the paper conveyance device 100 and the paper processing device 102, and FIG. 3 is a schematic planar view of the paper conveyance device 100. FIG. 2 illustrates a case where a rotating punching machine is applied as an example of the paper processing device 102. However, as described above, the paper processing device 102 is not limited to a rotating punching machine.

Furthermore, the configurations of the paper conveyance device 100 and the paper processing device 102 described below are examples, and the present disclosure is not limited to these examples. For example, alternative configurations can be used, and portions of these configurations can be modified or omitted.

As illustrated in FIGS. 2 and 3, the paper conveyance device 100 is provided with a first conveyance unit 5. The first conveyance unit 5 conveys the paper sheets piled up in the paper piling area 15 to the paper processing device 102. The first conveyance unit 5 is provided with, for example, a suction type belt conveyor (hereafter referred to as "conveyor"). As illustrated in FIG. 3, for example, the conveyor is provided with a driving roller 1, an idle roller 2, a plurality of endless conveyor belts 3 spanned between the driving roller 1 and the idle roller 2, a conveyance driving unit 4, and the like.

The driving roller 1 is provided with, for example, a rotating shaft and four first pulleys (not illustrated) arranged at mutual intervals in the axial direction of the rotating shaft. The first pulleys are rotatably and integrally attached to the rotating shaft.

The idle roller 2 is provided with, for example, a shaft parallel to the rotating shaft of the driving roller 1, and four second pulleys (not illustrated) rotatable around the shaft. The second pulleys are arranged to oppose each of the four first pulleys.

Each conveyor belt 3 is spanned between the first pulleys of the driving roller 1 and the second pulleys of the idle roller 2. Each conveyor belt 3 has a plurality of ventilation holes 3*a* provided at predetermined intervals over the entire length thereof. Note that, as illustrated in FIG. 3, the conveyor belt 3 may be configured by a plurality of belts, or may be configured by a single belt.

The conveyance driving unit 4, for example, rotates the rotating shaft of the driving roller 1 at a fixed speed to move the conveyor belt 3 at a fixed speed. As a result, the paper arranged on the upper surface (paper conveying surface) of the conveyor belt 3 is conveyed toward the paper processing device 102 at a predetermined speed. The conveyance driving unit 4 is provided with, for example, a pulley 4*a* fixed to one end of the driving shaft of the driving roller 1, a motor 4*b* having a driving shaft parallel to the driving roller 1, a pulley 4*c* fixed to the driving shaft of the motor 4*b*, and an endless belt 4*d* spanned between the pulley 4*a* and the pulley 4*c*. For example, the number of revolutions of the motor 4*b* may be changed. By controlling the number of revolutions, it is possible to adjust the conveying speed of the first conveyance unit 5.

A restraining plate (stopper) 14 is provided on the upper surface of the conveyor belt 3, being provided along the width direction orthogonal to the longitudinal direction of the conveyor belt 3. A restraining plate 14 may be provided corresponding to each of the conveyor belts 3, or may be a single plate arranged so as to cross the entire conveying surface of the four conveyor belts 3. The restraining plate 14 can be moved along the longitudinal direction of the conveyor belt 3, and the arrangement position is changed depending on the size of the paper ejected from the paper conveyance device 100. The restraining plate 14 is held by a restraining plate holding portion 14*a*.

As illustrated in FIG. 2, a carry-in roller 13 is provided in the vicinity of the connecting portion with the paper processing device 101. The carry-in roller 13 accepts paper discharged from the paper processing device 101. The front end of the paper accepted by the carry-in roller 13 impacts the restraining plate 14, and the paper is sequentially piled up in the paper piling area 15. The paper piling area 15, for example, is an area provided between the lower end of the carry-in roller 13 and the restraining plate 14, and the size thereof changes depending on the arrangement of the restraining plate 14; that is, depending on the size of the paper.

In the paper conveyance device 100, a first sensor 51 is provided downstream from the paper piling area 15. The first sensor 51 detects that paper has passed a first paper detection position virtually set in the conveyance path of the paper in the first conveyance unit 5. The first sensor 51 is installed, for example, on a position where it can be confirmed that the paper has been stably conveyed.

In the paper conveyance device 100, a carry-out roller 16 is provided in the vicinity of the connecting portion with the paper processing device 102. The carry-out roller 16 accepts paper conveyed on the upper surface of the conveyor belt 3 and ejects it to the paper processing device 102.

In the paper conveyance device 100, a sensor for detecting the passage of paper may be provided downstream from the carry-in roller 13, for example, in the vicinity of the paper ejection portion of the carry-in roller 13. This sensor is used, for example, to count the number of sheets of paper ejected from the paper processing device 101.

Similarly, a sensor for detecting the passage of paper may be provided upstream from the carry-out roller 16, for example, in the vicinity of the paper accepting portion of the carry-out roller 16. This sensor is used, for example, to count the number of sheets of paper ejected from the paper conveyance device 100.

The paper conveyance device 100 is provided with, for example, a suction switching unit 7. The suction switching unit 7 is provided with, for example, a suction box 11 and a suction fan (intake source) 12 as illustrated in FIG. 3.

The suction box 11 is arranged between the upper portion and the lower portion of the conveyor belt 3. The suction box 11 is provided with, for example, an intake hole 11*a* on the upper surface. Each intake hole 11*a* is arranged so as to oppose the upper portion of each conveyor belt 3. Furthermore, as illustrated in FIG. 2, the suction box 11 is provided with a shutter 11*b* that opens and closes the intake hole 11*a*. The opening and closing of the shutter 11*b* is controlled by a shutter driving unit (not illustrated). The shutter driving unit is configured by, for example, a lift mechanism attached to the shutter 11*b*, a motor attached to the lift mechanism, or the like.

As illustrated in FIG. 3, the suction fan 12 is, for example, directly connected to the suction box 11, and is configured to generate negative pressure within the suction box 11. For example, during the operation of the paper conveyance device 100, the suction fan 12 is continually running.

Furthermore, the shutter 11*b* is controlled so as to open and close at a predetermined timing. As a result, when the shutter 11*b* is open, the paper arranged so as to oppose the suction box 11 is sucked onto the conveying surface of the conveyor belt 3 via the ventilation holes 3*a* provided in the conveyor belt 3. Furthermore, when the shutter 11*b* is closed, the paper is not sucked to the conveyor belt 3.

Each unit of the paper conveyance device 100 described above is controlled by the control device 50 (see FIG. 1). The control device 50 controls, for example, a roller driving unit (not illustrated) that drives the carry-in roller 13, a conveyance driving unit 4 that drives the first conveyance unit 5 (see FIG. 3), and a roller driving unit that drives the carry-out roller 16 (not illustrated). Furthermore, the control device 50 controls the suction switching unit 7, for example, the fan driving of the shutter driving unit (not illustrated) and suction fan 12 that controls the opening and closing of the shutter 11*b* of the suction box 11.

Furthermore, the control device 50 controls the conveyance of paper based on a conveyance request signal transmitted from the conveyance control unit 71 (see FIG. 5) described hereafter. For example, the control device 50 conveys the paper after receiving the conveyance request signal. More specifically, the control device 50 opens the shutter 11*b* of the suction box 11 to attract the bottommost paper from among the piled up paper sheets to the conveying surface of the conveyor belt 3 and separate it from the remaining paper sheets, and the separated paper is conveyed to the paper processing device 102 by the first conveyance unit 5.

According to the paper conveyance device 100 described above, while operating, paper is accepted by the carry-in roller 13 from the upstream paper processing device 101, and the front end of the paper impacts the restraining plate 14 and is sequentially piled up on the paper piling area 15. Furthermore, by opening the shutter 11*b* of the suction box 11, the bottommost paper from among the piled up paper sheets is attracted to the conveying surface of the conveyor belt 3 by the suction box 11 and is separated from the other paper sheets. By driving the driving roller 1, the bottommost paper is supplied to the downstream paper processing device 102 by the conveyor belt 3.

Next, the paper processing device 102 will be described. The paper processing device 102 is a device for continuously processing in, for example, a predetermined cycle. As an example thereof, in the present embodiment, a rotating punching machine (rotary die cutter) that continuously performs punching processing will be described. Here, "punching processing" includes, for example, embossing processing, ribbing processing, perforation processing, and the like.

As illustrated in FIG. 2, the paper processing device 102, which is a rotating punching machine is provided with, for example, a second conveyance unit 22 and a punching unit 24. Further, the paper processing device 102 may be provided with a carry-in roller 21, a paper positioning roller 23, and the like.

The carry-in roller 21 accepts paper conveyed from the paper conveyance device 100. For example, the carry-in roller 21 is provided in the vicinity of the connecting portion with the paper conveyance device 100, and ejects the accepted paper to the second conveyance unit 22. For example, a second sensor 52 for detecting the passage of paper is provided between the carry-in roller 21 and the second conveyance unit 22. The second sensor 52 outputs a sensor detection signal to the control device 70 when, for example, the front end of the paper in the conveying direction is detected. Note that the second sensor 52 may be omitted as appropriate.

The second conveyance unit 22 conveys the paper accepted by the carry-in roller 21 to the punching unit 24. The second conveyance unit 22 is provided with, for example, a suction type belt conveyor (hereafter referred to as "conveyor"). For example, the conveyor is provided with a driving roller 31, an idle roller 32, an endless conveyor belt 33 spanned between the driving roller 31 and the idle roller 32, a conveyance driving unit 34, and the like. The configuration of the driving roller 31 and the idle roller 32 is, for example, the same as that of the first conveyance unit 5 of the paper conveyance device 100 described above.

Similar to the conveyor belt 3 illustrated in FIG. 3, the conveyor belt 33 may be configured by a plurality of belts, or may be configured by a single belt. Moreover, similar to conveyor belt 3, the conveyor belt 33 has a plurality of ventilation holes (not illustrated) provided at predetermined intervals over the entire length thereof.

The conveyance driving unit 34, for example, rotates a rotating shaft of the driving roller 31 at a fixed speed to move the conveyor belt 33 at a fixed speed. As a result, the paper arranged on the conveyor belt 33 is conveyed to the downstream punching unit 24 described hereafter. The conveyance driving unit 34 is provided with, for example, a motor fixed to one end of the rotating shaft of the driving roller 31. Furthermore, as illustrated in FIG. 3, the motor may be indirectly connected to the drive shaft of the driving roller via a pulley and a belt. For example, the number of revolutions of the motor may be changed.

Furthermore, the paper processing device 102 may include a suction switching unit (not illustrated) similar to the paper conveyance device 100.

The punching unit 24 is provided with a processing roller 35 and a receiving roller 36. The processing roller 35 is, for example, arranged in parallel with the driving roller 31. The receiving roller 36 is provided so as to oppose the processing roller 35 with the conveying surface interposed therebetween. For example, the receiving roller 36 is arranged parallel to the processing roller 35 and the peripheral surface thereof is arranged at a fixed interval from the peripheral surface of the processing roller 35. For example, a sheet-shaped blade 35*a* (see FIG. 6) is mounted on the peripheral surface of the processing roller 35.

The processing roller 35 is rotationally driven by the roller driving unit 37. The roller driving unit 37 has, for example, a motor 42. By controlling the revolutions of the motor 42 to be at a predetermined rotation speed, the processing roller 35 and the receiving roller 36 rotate in synchronization at equal speeds.

For example, the roller driving unit 37 is provided with a pulley 41 fixed to one end of the driving shaft of the receiving roller 36, the motor 42 having a driving shaft parallel to the receiving roller 36, a pulley 43 fixed to the driving shaft of the motor 42, and an endless belt 44 spanned between the pulley 41 and the pulley 43. By driving the motor 42, the receiving roller 36 rotates at a constant speed.

Furthermore, an interlocking connection mechanism (not illustrated) is connected to the rotating shaft of the receiving roller 36. As a result, the processing roller 35 is rotated in synchronization with the rotation of the receiving roller 36.

Note that the configuration of the roller driving unit 37 is one example, and a well-known roller driving unit can be appropriately adopted.

A rotation position detection unit 45 is arranged between the receiving roller 36 and the motor 42. A rotary encoder is one example of the rotation position detection unit 45. An output pulse of the rotation position detection unit 45 is output to the control device 70 (see FIG. 1). The control device 70 calculates, for example, the rotation position (0° to 360°) of a reference position P0 virtually set in the processing roller 35 based on the output pulse from the rotation position detection unit 45.

Furthermore, upstream from the processing roller 35 and the receiving roller 36, the paper positioning roller 23 is provided that receives the paper from the second conveyance unit 22 and supplies the paper to the processing roller 35.

Furthermore, a third sensor 53 for detecting the passage of paper is provided on a second paper detection position virtually set between the paper positioning roller 23 and the processing roller 35. In other words, the paper detection position by the third sensor 53 is the second paper detection position. The third sensor 53, for example, transmits a sensor detection signal to the control device 70 (see FIG. 1) when detecting that the front end of the paper has passed. Furthermore, a flat support plate that supports the lower surface of the paper may be provided between the paper positioning roller 23 and the processing roller 35.

During operation of the paper processing device 102, the processing roller 35 and the receiving roller 36 are continuously rotationally driven by the roller driving unit 37 at a fixed speed. Further, the paper carried in from the paper conveyance device 100 via the carry-in roller 21 is conveyed toward the punching unit 24 by the second conveyance unit 22. The paper that has been conveyed by the second conveyance unit 22 passes a gap in the paper positioning roller 23 and is conveyed to the punching unit 24. In the punching unit 24, the paper is punched by the blade 35*a* (see FIG. 6) when passing between the processing roller 35 and the receiving roller 36. The punched paper is conveyed by a third conveyance unit 25 provided downstream, and is piled up in a predetermined piling area (not illustrated). Note that for the configuration of the third conveyance unit 25, for example, the same configuration as that of the second conveyance unit 22, or a well-known configuration is adopted.

Each unit provided in the paper processing device 102 described above is controlled by the control device 70. The control device 70, for example, controls the roller driving unit (not illustrated) that drives the carry-in roller 21, the conveyance driving unit 34, the roller driving unit (not illustrated) that drives the paper positioning roller 23, the roller driving unit 37 that drives the punching unit 24, the conveyance driving unit (not illustrated) that drives the third conveyance unit 25, and the like. More specifically, the roller driving unit (not illustrated) that drives the carry-in roller 21, the conveyance driving unit 34, the roller driving unit (not illustrated) that drives the paper positioning roller 23, and the conveyance driving unit (not illustrated) that drives the third conveyance unit 25 are controlled by the paper feed control unit 72. Furthermore, the roller driving unit 37 that drives the punching unit 24 is controlled by the processing control unit 73. Furthermore, the conveyance control unit 71 supplies paper to the punching unit 24 at an appropriate timing in cooperation with the paper feed control unit 72.

Furthermore, the sensor detection signals of the second sensor 52 and the third sensor 53 provided in the paper processing device 102 are input to the control device 70. The conveyance control unit 71 and the paper feed control unit 72 of the control device 70 convey paper and feed paper based on these sensor detection signals.

Next, the conveyance control unit 71 that controls the timing for conveying the paper of the paper conveyance device 100 in the paper processing system 10 described above will be described. In the present embodiment, a case is given as an example wherein the conveyance control unit 71 is mounted in the control device 70, but as described above, the present disclosure is not limited to this example.

Figure 4:
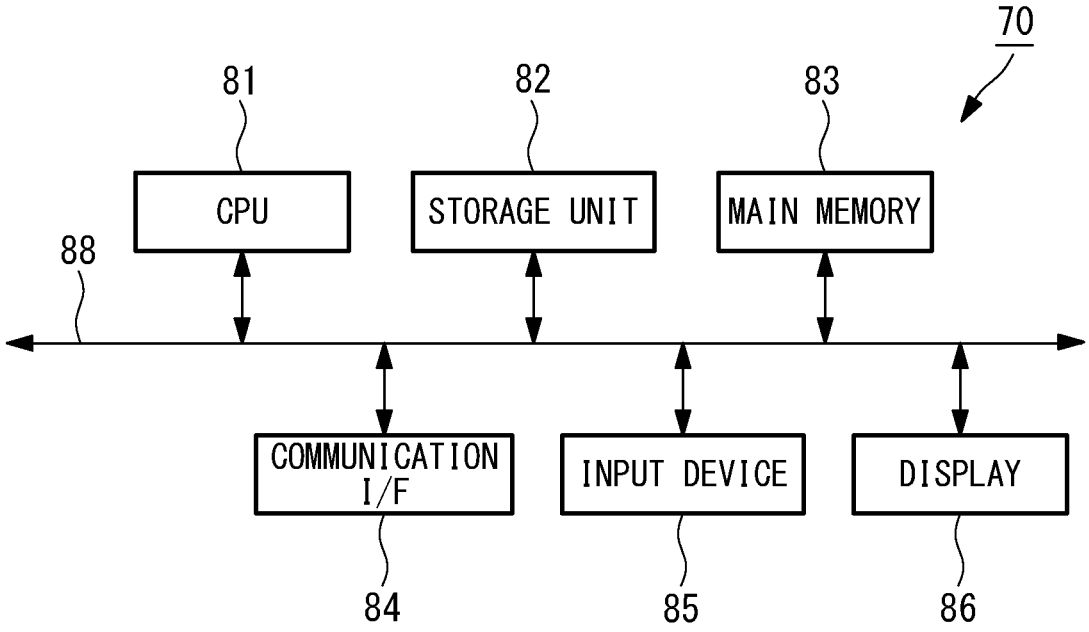
FIG. 4 is a diagram illustrating an example of a hardware configuration of the control device according to one embodiment of the present disclosure.

FIG. 4 is a diagram illustrating an example of a hardware configuration of the control device 70 according to the present disclosure. As illustrated in FIG. 4, the control device 70 is provided with, for example, a CPU 81, a storage unit 82 for storing a program executed by the CPU 81 and data or the like referenced by the program, a main memory 83 functioning as a work area when executing each program, a communication interface 84 for connecting to a network, an input device 85, a display 86, and the like. Each of these units is connected via, for example, a bus 88. Examples of the storage unit 82 include magnetic disks such as hard disk drives (HDD), magneto-optical disks, semiconductor memories such as solid state drives (SSD), and the like.

As an example, a series of processes for realizing the various functions described below are stored in the storage unit 82 in the form of a program (for example, a conveyance control program, a paper feed control program, a processing control program, and the like), and the CPU 81 reads these programs in the main memory 83 and executes information processing and computational processing to realize the various functions. Note that programs may be adapted in the form of a program pre-installed in the storage unit 82, a program provided being stored in another computer-readable storage medium, a program distributed via wired or wireless communication means, or the like. Examples of a computer-readable storage medium include a magnetic disk, a magneto-optical disk, CD-ROM, DVD-ROM, semiconductor memory, and the like.

Note that the control device 50 also has a similar configuration, and the various functions and processes described hereafter are realized by a processor such as a CPU reading a program stored in the storage unit to the main memory and executing computational processing.

Figure 5:
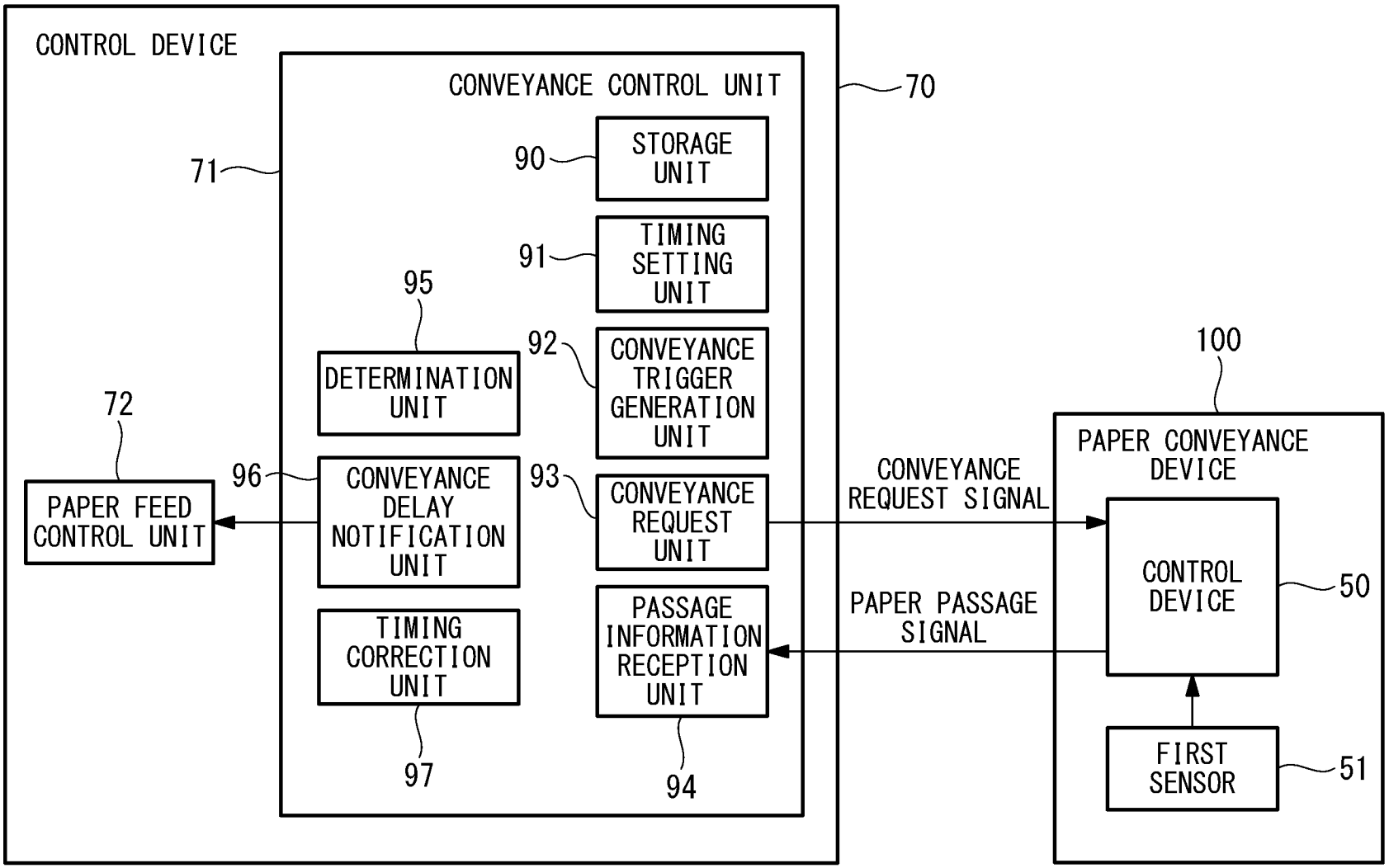
FIG. 5 is a function block diagram illustrating one example of a function realized by the conveyance control unit according to one embodiment of the present disclosure.

FIG. 5 is a function block diagram illustrating one example of a function realized by the conveyance control unit 71 according to the present embodiment.

As illustrated in FIG. 5, the conveyance control unit 71 is provided with, for example, a conveyance request unit 93, a passage information reception unit 94, a determination unit 95, and the like. Furthermore, the conveyance control unit 71 may be further provided with a storage unit 90, a timing setting unit 91, and a conveyance trigger generation unit 92. Furthermore, the conveyance control unit 71 may be further provided with, for example, a conveyance delay notification unit 96. Moreover, the conveyance control unit 71 may be further provided with a timing correction unit 97.

The timing setting unit 91 sets the conveyance request timing corresponding to a processing cycle of the paper processing device 102. For example, the timing setting unit 91 sets the conveyance request timing when starting operation of the paper processing system 10. Furthermore, when there are changes in set values such as the paper size, the paper conveying speed, and the rotation speed of the processing roller, the conveyance request timing is set. The paper size, the paper conveying speed, the rotation speed of the processing roller, and the like are set by being input from, for example, the input device 85 (see FIG. 4) provided in the control device 70. Furthermore, it may be configured to receive from another control device (for example, a higher-level device) via a network.

As described above, the paper processing device 102 performs processing (punching) in a predetermined cycle during operation. Therefore, it is necessary to supply the paper to the processing roller 35 at an appropriate timing according to the processing cycle. The timing setting unit 91 sets the paper conveyance request timing according to such periodic and continuously performed processing.

The conveyance request timing will be described below with reference to FIG. 6.

Figure 6:
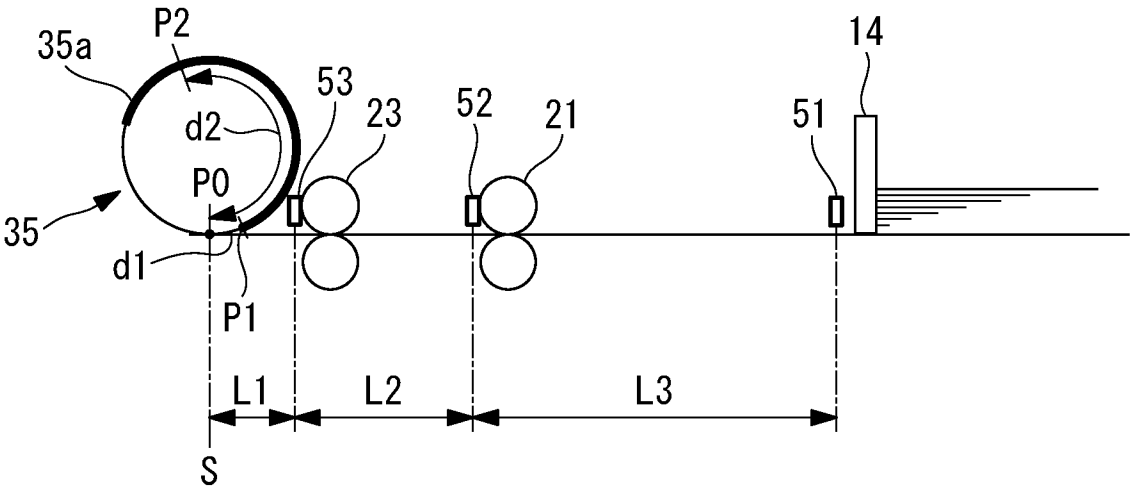
FIG. 6 is a diagram for describing the conveyance request timing according to one embodiment of the present disclosure.

As illustrated in FIG. 6, the blade 35*a* is attached on a predetermined range on the outer circumference of the processing roller 35 of the paper processing device 102. Furthermore, a reference position P0 is set on the processing roller 35. This reference position P0 is a virtual position set for convenience in order to synchronize with the conveyance request timing.

In the present embodiment, as an example, when the reference position P0 reaches the lowest point S of the processing roller 35, control is performed so that the front end of the paper reaches the lowest point S of the processing roller 35. In the processing roller 35, a distance d1 between the reference position P0 and a front end P1 of the blade 35*a* is a distance corresponding to the processing start position on the paper. That is, it can be said that the reference position P0 is a virtual position that is set each time according to the front end P1 of the blade 35*a* and the processing start position of the paper.

The conveyance request timing can be found by calculation based on, for example, a distance L1 between a lowest point S of the processing roller 35 and the installation position of the third sensor 53, a distance L2 between the third sensor 53 and the second sensor 52, a distance L3 between the second sensor 52 and the first sensor 51, a rotation speed v1 of the processing roller 35, and a conveying speed v2 of the paper. Note that the paper conveying speed of the paper conveyance device 100 and the paper conveying speed of the paper processing device 102 are set to the same speed. Note that the second sensor 52 can be omitted. In such a case, the distance from the third sensor 53 to the first sensor 51 (L2+L3) may be used.

For example, the time t from when the paper passes the first sensor 51 to when it reaches the lowest point S of the processing roller 35 (hereinafter referred to as "conveyance time") is expressed by the following formula.

$$t=(L1+L2+L3)/v2 \quad (1)$$

Therefore, the conveyance request timing is set prior to the time t from the timing when the reference position P0 of the processing roller 35 reaches the lowest point S of the processing roller 35. In other words, the conveyance request timing is the timing at which the reference position P0 reaches the rotation position P2, as shown in FIG. 6.

The distance d2 between the reference position P0 and the rotation position P2 is expressed by the following formula (2).

$$d2=v1\times t \quad (2)$$

Here, the distances L1 to L3, the rotation speed v1, and the paper conveying speed v2 are values based on, for example, design values. Furthermore, in a system in which the rotation speed v1 of the processing roller 35 and the paper conveying speed v2 can be changed, the input set values corresponding to each time may be used.

The information of the conveyance request timing set by the timing setting unit 91 is stored in the storage unit 90. For example, a determination condition for determining the conveyance request timing is stored in the storage unit 90. Examples of the determination condition include information relating to the rotation position P2 of the processing roller 35. More specifically, the angle information of the rotation position P2 with respect to the reference position P0, the distance d2 from the reference position P0 to the rotation position P2, the time information from when the reference position P0 passes the lowest point S to when it reaches the rotation position P2, and the like are included.

In the present embodiment, a case is described below as an example wherein the rotation position of the rotation position P2 is stored in the storage unit 90 as information of the conveyance request timing. Note that because the rotation position P2 is a rotation position used for determining the conveyance request timing, it is hereinafter referred to as "conveyance determination position P2."

The conveyance trigger generation unit 92 generates a trigger based on information of the conveyance request timing stored in the storage unit 90. For example, the conveyance trigger generation unit 92 generates a conveyance trigger when the conveyance determination position P2 and the reference position P0 stored in the storage unit 90 match. For example, the conveyance trigger generation unit 92 calculates the rotation position (0° to 360°) of the reference position P0 virtually set in the processing roller 35 based on the output pulse from the rotation position detection unit 45. The conveyance trigger is generated when the rotation position of the reference position P0 matches the conveyance determination position P2.

When the conveyance trigger is generated by the conveyance trigger generation unit 92, the conveyance request unit 93 transmits a conveyance request signal to the control device 50 of the paper conveyance device 100. More specifically, when a conveyance normal signal is input from the determination unit 95 described hereafter, the conveyance request unit 93 transmits the conveyance request signal at the next paper feed trigger. Meanwhile, when the conveyance delay signal is input from the determination unit 95, the conveyance request unit 93 does not transmit the conveyance request signal at the next paper feed trigger; that is, the conveyance request unit 93 skips transmitting the conveyance request signal at this timing, and waits until the paper feed trigger occurs again.

The control device 50 of the paper conveyance device 100 feeds the paper after receiving the conveyance request signal. Specifically, the control device 50 opens the shutter 11*b* of the suction box 11, and the bottommost paper from among the paper sheets piled up on the paper piling area 15 is separated from the other paper sheets. Accordingly, one sheet of separated paper is supplied to the paper processing device 102 by the conveyor belt 3.

When the first sensor 51 detects the passage of paper in the paper conveyance device 100, the first sensor 51 outputs a sensor detection signal to the control device 50. The control device 50 transmits a paper passage signal to the control device 70 after receiving the sensor detection signal.

Here, it is preferable that the first sensor 51 outputs a sensor detection signal when the front end of the paper is detected. This is because, for example, when trying to detect the back end of the paper, the time from when the front end passes to when the back end is detected changes when the size of the paper changes, which complicates the computational processing. Furthermore, because the reference position P0 on the processing roller 35 is also set according to the front end of the paper, it is preferable to detect the front end of the paper to simplify the computational processing. Note that the same applies to the second sensor 52 and the third sensor 53.

The passage information reception unit 94 of the conveyance control unit 71 receives a paper passage signal.

The determination unit 95 determines whether there is a conveyance delay based on the reception timing of the paper passage signal. For example, the determination unit 95 determines whether a conveyance delay has occurred depending on whether the paper passage signal is received within a predetermined period after the conveyance request signal is transmitted by the conveyance request unit 93.

For example, the predetermined period is set based on the time required from when the conveyance control unit 71 transmits the conveyance request signal until the paper conveyance device 100 conveys the paper in accordance with the conveyance request signal and the paper passes the installation position of the first sensor 51, and the adjustment time determined based on the mechanical properties of the paper positioning roller 23. For example, even if there is a slight deviation (error) in the conveyance timing in the paper conveyance device 100, as long as the time deviation is within a range that can be adjusted by the paper positioning roller 23, the rotation speed of the paper positioning roller 23 can be adjusted (including stopping rotation) to supply the paper to the processing roller 35 at an appropriate supply timing. However, if there is a conveyance timing deviation that exceeds a range that can be adjusted by the paper positioning roller 23, this time deviation cannot be absorbed by the paper positioning roller 23, so paper feeding must be stopped for one processing cycle and paper feeding must be started in the next processing cycle. The "predetermined period" corresponds to a time range of the paper conveyance timing that can be adjusted by the paper positioning roller 23 in this manner. The "predetermined period" is set in consideration of, for example, the acceleration/deceleration range of the driving motor that drives the paper positioning roller 23, the paper supply speed at which the paper positioning roller 23 can reliably grip (hold) the paper, and the like.

The determination unit 95 outputs a conveyance normal signal when, for example, the paper passage signal is received within the predetermined period after the conveyance request signal is transmitted. Meanwhile, the conveyance delay signal is output when the paper passage signal is not received within the predetermined period. The conveyance normal signal is output to, for example, the conveyance request unit 93. Furthermore, the conveyance delay signal is, for example, output to the conveyance request unit 93 and the conveyance delay notification unit 96.

When the conveyance delay signal is input, the conveyance delay notification unit 96 outputs the conveyance delay signal to the paper feed control unit 72. When the conveyance delay signal is input, the paper feed control unit 72 temporarily stops the paper positioning roller 23 and adjusts the timing of paper feeding to the processing roller 35. The control performed by the paper feed control unit 72 will be described later.

The timing correction unit 97 corrects the conveyance request timing information stored in the storage unit 90. For example, the conveyance request timing set by the timing setting unit 91 described above is a theoretical value obtained via computation. However, during actual operation, the paper feeding time by the first conveyance unit 5, the time required to take out one sheet from the paper piling area 15 and move it, and the time from when the paper conveying begins to when the lowest point S of the processing roller 35 is reached may deviate from the theoretical value due to various errors such as conveying speed by the first conveyance unit 5 and the second conveyance unit 22. Similarly, the rotation speed of the processing roller 35 may change due to deviations due to the vertical movement of the processing roller. The timing correction unit 97 is provided to correct such deviations. Note that the details of the correction method by the timing correction unit 97 will be described later.

Next, various processes performed by the conveyance control unit 71 described above will be described with reference to drawings.

Figure 7:
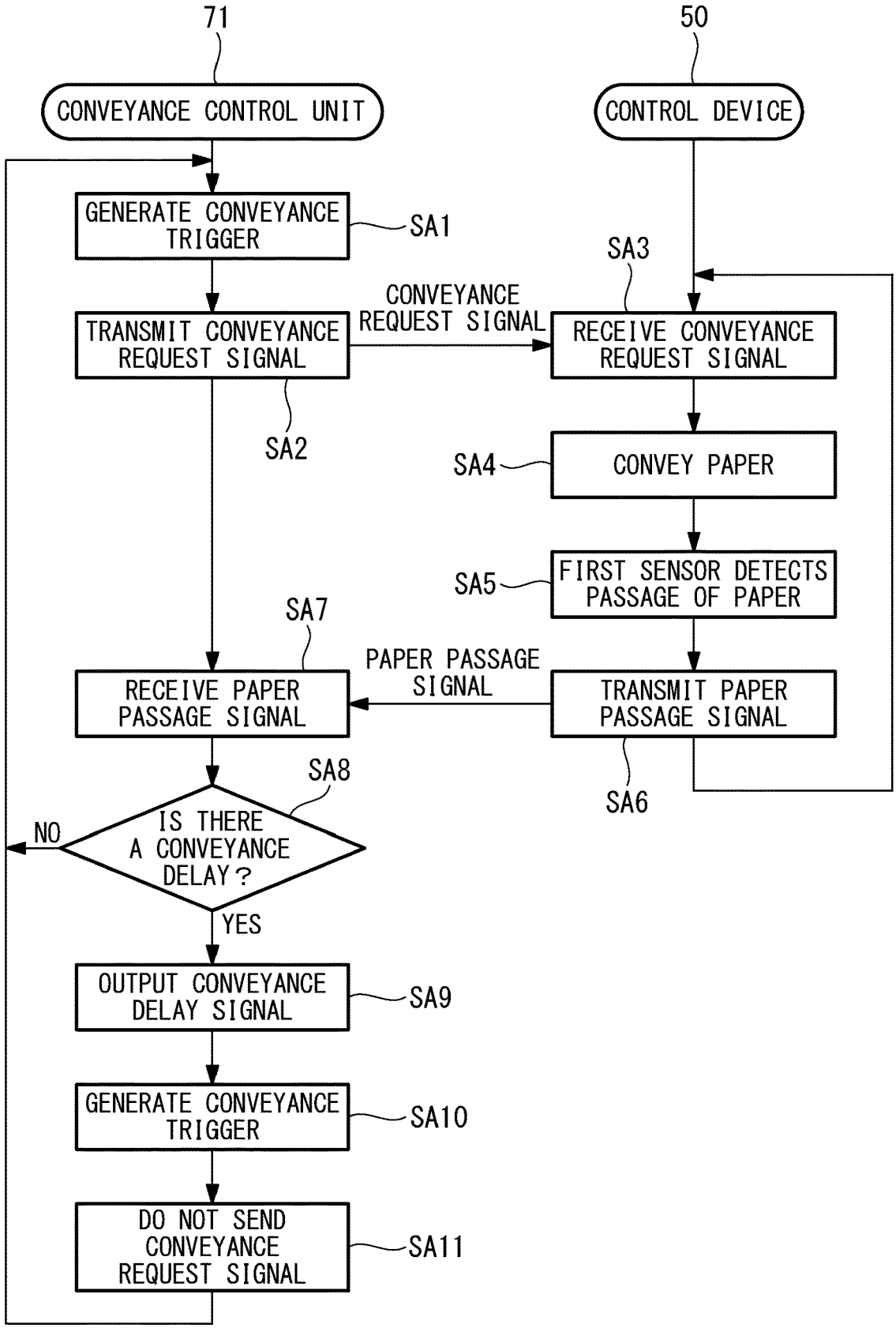
FIG. 7 is a flowchart illustrating one example of a processing procedure performed by the conveyance control unit and control device of the paper conveyance device according to one embodiment of the present disclosure.

FIG. 7 is a flowchart illustrating one example of a processing procedure executed by the conveyance control unit 71 and control device 50 of the paper conveyance device 100. The series of processes executed in the conveyance control unit 71 described hereafter are stored in the storage unit 82 (see FIG. 4) in the form of a program (for example, a conveyance control program and the like) and realized by the CPU (processor) 81 reading this program in the main memory 83 and executing information processing and computational processing. Moreover, the same applies to the control device 50.

First, during operation, the conveyance control unit 71 generates a conveyance trigger at the conveyance request timing according to the processing cycle (SA1), and transmits the conveyance request signal to the control device 50 of the paper conveyance device 100 at the timing when the conveyance trigger occurs. (SA2). The control device 50 receives the conveyance request signal (SA3) and then conveys the paper (SA4). When the passage of the paper is detected by the first sensor 51 (SA5), the control device 50 transmits the paper passage signal to the conveyance control unit 71 (SA6).

Upon receiving the paper passage signal (SA7), the conveyance control unit 71 determines whether a conveyance delay has occurred. For example, after the conveyance request signal is transmitted, it is determined whether the paper passage signal has been received within the predetermined period (SA8). As a result, when the paper passage signal is received within the predetermined period, it is determined that there is no conveyance delay (SA8: NO), and the process returns to step SA1. As a result, the conveyance request signal is transmitted to the control device 50 of the paper conveyance device 100 at the timing when the next conveyance trigger occurs (SA1, SA2).

Meanwhile, in step SA8, for example, when the paper passage signal is not received within the predetermined period, it is determined that there is a conveyance delay (SA8: YES), and the conveyance delay signal is output to the paper feed control unit 72 (SA9). As a result, as will be described hereafter, in the paper feed control unit 72 of the control device 70, processing is performed to adjust the timing of the paper in which the conveyance delay has occurred.

Subsequently, when the conveyance trigger occurs (SA10), the process returns to step SA1 without transmitting the conveyance request signal (SA11) at this conveyance trigger.

In this manner, when it is determined in step SA8 that a conveyance delay has occurred, the conveyance request signal is not transmitted when the next conveyance trigger is generated, in other words, the transmission of the conveyance request signal is skipped, and it will be in a standby state until the next conveyance trigger occurs. As a result, it is possible to prevent a plurality of sheets from accumulating in the paper processing device 102 due to the next sheet being conveyed even though a conveyance delay has occurred.

Furthermore, when the paper accumulates in this manner, a larger than necessary supply of paper to the processing roller 35 must be prevented. Therefore, by controlling as in the present embodiment, it is possible to promptly start paper feeding without stopping paper feeding more than necessary. As a result, it is possible to suppress decreases in processing efficiency.

Next, the process executed by the paper feed control unit 72 during the operation of the paper processing system 10 will be described. The series of processes described hereafter are stored in the storage unit 82 (see FIG. 4) provided in the control device 70 in the form of a program (for example, a paper feed control program and the like), this program is read into the main memory 83 by the CPU 81, and various functions are realized by executing information processing and computational processing.

Figure 8:
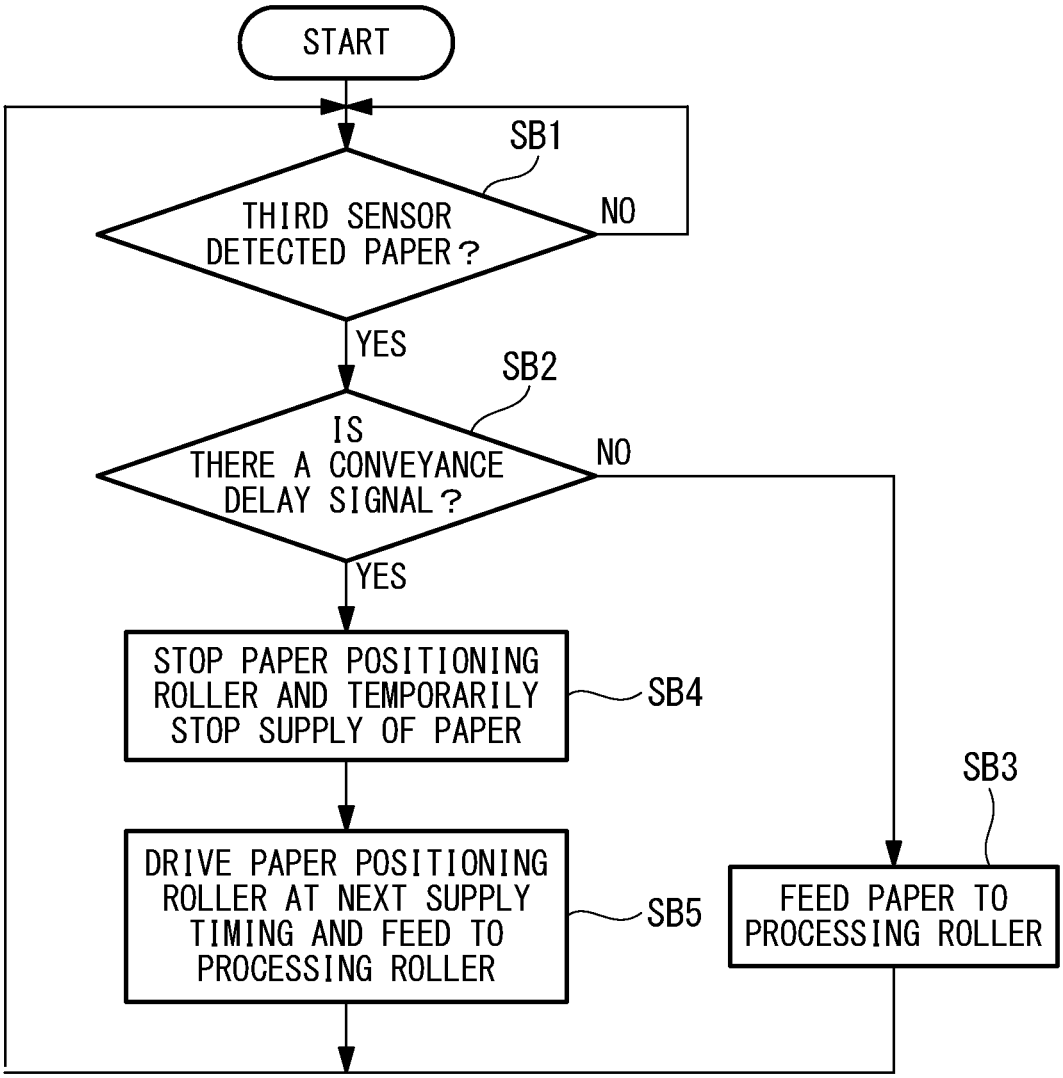
FIG. 8 is a flowchart illustrating one example of a paper feed control processing procedure performed by the paper feed control unit relating to one embodiment of the present disclosure.

FIG. 8 is a flowchart illustrating one example of a paper feed control processing procedure performed by the paper feed control unit 72.

First, when paper is detected by the third sensor 53 (SB1: YES), it is determined whether the conveyance delay signal is input (SB2). Specifically, it is determined whether the conveyance delay signal has been input between the previous paper detection by the third sensor 53 and the current paper detection.

As a result, when the conveyance delay signal is not input (SB2: NO), the paper is supplied to the processing roller 35 by the paper positioning roller 23 (SB3), and the process returns to step SB1.

Meanwhile, when the conveyance delay signal is input (SB2: YES), the paper positioning roller 23 is stopped and the supplying of paper is temporarily stopped (SB4). That is, when the conveyance delay signal is input, it can be seen that the paper detected by the third sensor 53 indicates the conveyance delay occurring in the paper conveyance device 100. If such paper is supplied as is to the processing roller 35, a positional deviation exceeding the error range will occur, resulting in a defective product. Therefore, in this case, the feeding of paper is temporarily stopped, and a standby mode is entered until the next paper feed timing.

Note that the "paper feed timing" is determined based on the rotation speed of the processing roller 35, the distance L1 between the processing roller 35 and the third sensor 53, the rotation speed of the paper positioning roller 23, and the like. Note that the timing may be determined according to the "conveyance request timing" setting method described above.

Subsequently, when the reference position P0 (see FIG. 6) of the processing roller 35 approaches the lowest point S and the next paper feed timing is reached, the paper feed control unit 72 restarts the rotation of the paper positioning roller 23 to supply paper to the processing roller 35 (SB5), and the process returns to step SB1.

In this manner, when a paper conveyance delay occurs in the paper conveyance device 100, a conveyance delay signal notifying the occurrence of a conveyance delay is output from the conveyance control unit 71 to the paper feed control unit 72. As a result, the paper feed control unit 72 can adjust the supply timing of the paper in which the conveyance delay has occurred. That is, when a conveyance delay occurs, the paper positioning roller 23 is temporarily stopped to skip one processing cycle and enter a standby state, and the paper is supplied at the appropriate paper feed timing in the next processing cycle. As a result, even if a conveyance delay occurs, the front edge of the paper can be aligned with the reference position P0, and punching can be performed at an appropriate position.

Furthermore, in this manner, when one cycle of processing is skipped in the paper processing device 102 and the standby state is entered to match the timing, the conveying of paper is similarly held at standby in the paper conveyance device 100 (SA10 and SA11 in FIG. 7). As a result, the paper feeding in the paper processing device 102 and the conveying in the paper conveyance device 100 can be linked, and a plurality of paper sheets can be prevented from accumulating in the paper processing device 102.

Figure 9:
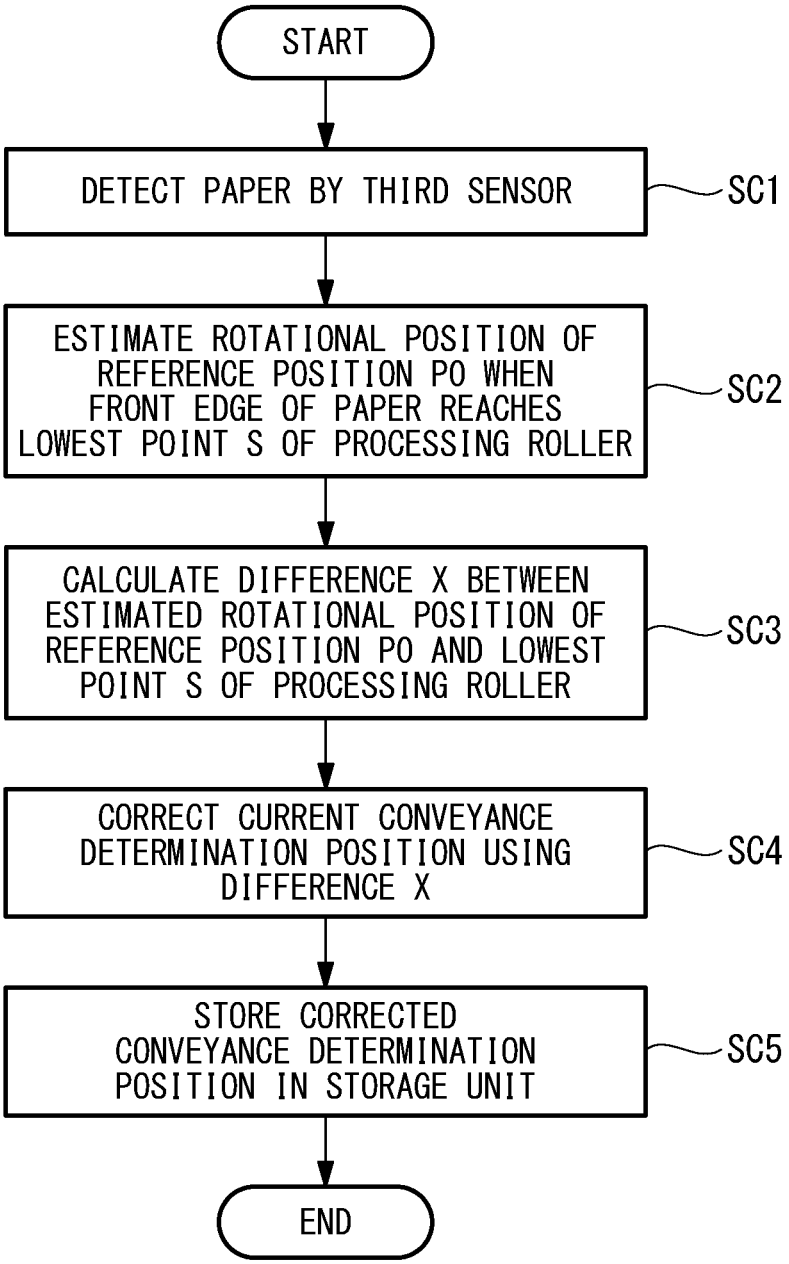
FIG. 9 is a flowchart illustrating one example of a timing correction processing procedure performed by the timing correction unit according to one embodiment of the present disclosure.

Next, a method for correcting the conveyance request timing using the timing correction unit 97 (see FIG. 6) will be described with reference to FIG. 9. FIG. 9 is a flowchart illustrating one example of a timing correction processing procedure performed by the timing correction unit 97.

The timing for correcting the conveyance request timing is not particularly limited, but examples include immediately after the conveyance request timing is set by the timing setting unit 91, at a predetermined time interval, when a processing deviation amount exceeds a certain value, and the like. Furthermore, correction of the conveyance request timing by the timing correction unit 97 is performed when the paper processing system 10 is in operation; that is, when processing is being performed by the processing roller 35.

For example, as illustrated in FIG. 7, the conveyance request signal is transmitted to the control device 50 based on the current conveyance request timing stored in the storage unit 90, paper feeding is performed, and when the first sensor 51 detects the passage of paper, the paper passage signal is transmitted from the control device 50.

When this paper is conveyed from the paper conveyance device 100 to the paper processing device 102 and detected by the third sensor 53 (SC1), the timing correction unit 97 estimates the rotation position of the reference position P0 when the front edge of the paper reaches the lowest point S of the processing roller 35 based on the timing of detection by the third sensor 53 (SC2) This estimated position can be found by calculation based on the rotation position of the reference position P0 in the processing roller 35 when the paper is detected by the third sensor 53, the distance L1 between the third sensor 53 and the lowest point S of the processing roller 35, the rotation speed v1 of the processing roller 35, and the conveying speed v2 of the paper.

Subsequently, the timing correction unit 97 calculates the difference X between the estimated rotation position of the reference position P0 and the lowest point S of the processing roller 35 (SC3). Next, the current conveyance determination position P2; that is, the conveyance determination position P2 stored in the storage unit 90, is corrected by using a difference X (SC4). Specifically, when the rotation position of the estimated reference position P0 is ahead of the lowest point S, the conveyance determination position P2 is corrected by the difference X in the direction approaching the lowest point S. As a result, the conveyance request timing of the conveyance request signal can be delayed by a time corresponding to the difference X. Meanwhile, when the estimated rotation position of the reference position P0 is after the lowest point S, the conveyance determination position P2 is corrected by the difference X in the direction going away from the lowest point S. As a result, the conveyance request timing of the conveyance request signal can be expedited by a time corresponding to the difference X.

By correcting the conveyance determination position P2 in this manner, the deviation between the front edge of the paper and the reference position P0 of the processing roller 35 can be reduced, and processing position deviation can be suppressed within a predetermined error range.

When the conveyance determination position P2 is corrected, the timing correction unit 97 stores the corrected conveyance determination position P2 in the storage unit 90 (SC5). As a result, the conveyance determination position P2 stored in the storage unit 90 is updated to the corrected conveyance determination position P2, and thereafter, the conveyance trigger is generated based on the updated conveyance determination position P2.

As described above, the following effects are brought about according to the conveyance control device, conveyance control method, and program according to the present embodiment.

For example, the conveyance control unit (conveyance control device) 71 according to the present embodiment is provided with the conveyance request unit 93 for transmitting a conveyance request signal to the paper conveyance device 100 at a conveyance request timing corresponding to the processing cycle of the paper processing device 102, the passage information reception unit 94 for receiving a paper passage signal indicating that paper has been sent out from the paper conveyance device 100, and the determination unit 95 for determining the presence of a conveyance delay based on the reception timing of the paper passage signal.

When it is determined by the determination unit 95 that a conveyance delay has not occurred, the conveyance request unit 93 transmits the conveyance request signal at a conveyance request timing corresponding to the next processing cycle. Meanwhile, when it is determined by the determination unit 95 that a conveyance delay has occurred, the device stands by until the next conveyance request timing without transmitting the conveyance request signal in the conveyance request timing corresponding to the next processing cycle.

In this manner, when a paper conveyance delay does not occur in the paper conveyance device 100, paper is conveyed at the next processing timing, and the paper can thereby be supplied at an appropriate timing according to the processing timing. As a result, continuous operation is possible without reducing the processing capacity of the paper processing device 102.

Furthermore, by not conveying paper at the next processing timing when a paper conveyance delay has occurred in the paper conveyance device 100, a plurality of sheets of paper can be prevented from accumulating in the paper processing device 102, which does occur when the next paper is conveyed even though a conveyance delay has occurred.

Furthermore, when the paper accumulates in this manner, a larger than necessary supply of paper to the processing roller 35 must be prevented. Therefore, by controlling as in the present embodiment, it is possible to promptly start paper feeding without stopping paper feeding more than necessary. As a result, it is possible to suppress decreases in processing efficiency.

Furthermore, the conveyance control unit (conveyance control device) 71 according to the present embodiment is provided with the timing correction unit 97 for correcting the conveyance request timing. The timing correction unit 97 is provided in the paper processing device 102, estimates the actual processing position with respect to the paper based on the timing when the paper passes the paper detection position provided further upstream than the punching unit 24 that performs processing, and corrects the conveyance request timing based on the amount of deviation between the estimated processing position and a preset reference processing position.

Because the conveyance request timing is corrected based on the processing position during actual operation in this manner, the conveyance request signal can be transmitted at an appropriate conveyance request timing according to the operation state. This makes it possible to suppress the position deviation in processing within a predetermined error range.

Note that instead of the estimated processing position, the conveyance request timing may be corrected based on the amount of deviation between the actual processing position with respect to the paper and the preset reference processing position.

Furthermore, according to the conveyance control unit (conveyance control device) 71 according to the present embodiment, when the paper passage signal is not received within the predetermined period, the conveyance delay notification unit 96 is provided to notify the conveyance delay signal to the paper feed control unit 72.

As a result, the paper feed control unit 72 can be notified in advance that there is a conveyance delay. As a result, the paper feed control unit 72 can adjust the timing of the paper in which the conveyance delay occurred, and paper can be supplied to the punching unit 24 at the appropriate paper feed timing.

Furthermore, an example was given in the present embodiment wherein the control device 70 is provided with the function of the conveyance control unit 71, but the present disclosure is not limited to this. The conveyance control unit 71 may be mounted on the control device 50, and may also be mounted on an upper level control device of the control device 70. Furthermore, the conveyance control unit 71 may exist as an independent control device.

As described above, when the conveyance control unit 71 is mounted on a device different from the control device 70, for example, information mutually shared between each unit provided in the paper processing device 102 and the conveyance control unit 71 may be transmitted and received via a network (communication medium). For example, information to be transmitted and received includes the conveyance delay signal, the output pulse by the rotation position detection unit 45, the rotation position of the processing roller calculated based on the output pulse, and the like.

The present disclosure has been described above using the embodiments, but the technical scope of the present disclosure is not limited to the scope described in the above embodiments. Various modifications or improvements can be made to the above embodiments without departing from the main points of the invention, and the modified or improved forms are also included in the technical scope of the present disclosure. Furthermore, the above embodiments may be combined as appropriate.

Furthermore, the flow of information provision processing described in the above embodiments is one example, and unnecessary steps may be deleted, new steps may be added, or the processing order may be changed within a range that does not deviate from the main points of the present disclosure.

For example, in the embodiments described above, the determination unit 95 determines whether a conveyance delay has occurred based on whether the paper passage signal is received within a predetermined period after the conveyance request signal is transmitted. However, the method for determining whether a conveyance delay has occurred is not limited to this example. For example, the rotation position of the reference position P0 of the processing roller 35 when the paper passage signal is received may be acquired from the rotation position detection unit 45, and whether a conveyance delay has occurred may be determined based on whether this rotation position is within a predetermined position range of the processing roller 35. Here, the "predetermined position range" is, for example, a position range corresponding to the above "predetermined period," and can be calculated by computing based on the conveyance determination position P2 and the rotation speed of the processing roller 35.

Furthermore, as described above, when determining whether a conveyance delay has occurred based on the rotation position of the reference position P0 of the processing roller 35 when a paper passage signal has been received, the timing correction unit 97 may correct the "predetermined position range." In this case, for example, the timing correction unit 97 temporarily stores the rotation position of the processing roller 35 when the paper passage signal has been received as a temporary paper passage determination position, and the stored temporary paper passage determination position may be corrected by the difference X. The "predetermined position range" is corrected by giving a margin of a predetermined range to the front and back centered around the corrected paper passage determination position. This predetermined range margin is a rotation position range corresponding to the predetermined period.

REFERENCE NUMERALS

1: Driving roller
2: Idle roller
3: Conveyor belt
3*a*: Ventilation hole
4: Conveyance driving unit
5: First conveyance unit
10: Paper processing system
11*b*: Shutter
14: Restraining plate
15: Paper piling area
22: Second conveyance unit
23: Paper positioning roller
24: Punching unit

35: Processing roller
35*a*: Blade
36: Receiving roller
37: Roller driving unit
45: Rotation position detection unit
50: Control device
51: First sensor
52: Second sensor
53: Third sensor
60: Control device
70: Control device
71: Conveyance control unit (conveyance control device)
72: Paper feed control unit
73: Processing control unit
90: Storage unit
91: Timing setting unit
92: Conveyance trigger generation unit
93: Conveyance request unit
94: Passage information reception unit
95: Determination unit
96: Conveyance delay notification unit
97: Timing correction unit
100: Paper conveyance device
101: Paper processing device
102: Paper processing device

What is claimed is:

1. A conveyance control device for controlling a paper conveyance request timing of a paper conveyor configured to convey paper ejected from an upstream first paper processing device to a downstream second paper processing device, the conveyance control device comprising:

a conveyance request unit configured to transmit a conveyance request signal to the paper conveyor at a conveyance request timing corresponding to a processing cycle of the second paper processing device;

a passage information reception unit configured to receive a paper passage signal indicating that paper has been sent from the paper conveyor; and a determination unit configured to determine whether there is a conveyance delay in the paper conveyor based on a reception timing of the paper passage signal, wherein the conveyance request unit is configured to transmit the conveyance request signal at the conveyance request timing corresponding to the next processing cycle when it is determined that a conveyance delay has not occurred, and wherein the conveyance request unit is configured not to transmit the conveyance request signal at the conveyance request timing corresponding to the next processing cycle when it is determined that a conveyance delay has occurred.

2. The conveyance control device according to claim 1, further comprising a timing correction unit configured to correct the conveyance request timing, wherein the timing correction unit is configured to estimate an actual processing position of paper based on a timing when the paper has passed a paper detection position the paper detection position being provided on the second paper processing device and being further upstream than a processing unit for performing processing, and wherein the timing correction unit is configured to correct the conveyance request timing based on a deviation amount between the estimated processing position and a preset reference processing position.

3. The conveyance control device according to claim 1, further comprising a conveyance delay notification unit configured to notify the second paper processing device of a conveyance delay signal when it is determined that a conveyance delay has occurred.

4. A non-transitory computer readable storage medium storing a computer program for causing a computer to function as the conveyance control device according to claim 1.

5. A paper processing device to which paper is supplied from a paper conveyor, comprising:

the conveyance control device according to claim 1.

6. The paper processing device according to claim 5, further comprising:

a processing unit configured to perform processing on paper supplied from the paper conveyor; and a control device, wherein the control device comprises a paper feed control unit configured to control feeding of paper to the processing unit, wherein the conveyance control device includes a conveyance delay notification unit configured to output a conveyance delay signal to the paper feed control unit when a conveyance delay has occurred in the paper conveyor, and wherein the paper feed control unit is configured to temporarily stop feeding of paper in the processing unit when the conveyance delay signal has been notified.

7. A paper processing system, comprising:

a paper conveyor configured to convey paper ejected from a first paper processing device;

a second paper processing device to which paper is supplied from the paper conveyor; and the conveyance control device according to claim 1.

8. The paper processing system according to claim 7, comprising:

a paper piling area where paper ejected from the first paper processing device is piled up;

a sensor provided in a conveyance path for conveying paper from the paper piling area to the second paper processing device, the sensor detecting that the paper has passed; and a control device configured to convey paper when a conveyance request signal is received and configured to transmit a paper passage signal when passage of the paper is detected by the sensor.

9. The paper processing system according to claim 8, wherein the sensor detects passage of the paper when a front edge of the paper is detected in a conveying direction.

10. The paper processing system according to claim 9, wherein the sensor is provided in a vicinity of an ejecting portion where paper is ejected from the paper piling area.

11. The conveyance control device according to claim 1, wherein the determination unit is configured to determine whether there is a conveyance delay in the paper conveyor, depending on whether the paper passage signal is received within a predetermined period after the conveyance request signal is transmitted.

12. A paper conveyor configured to convey paper ejected from an upstream first paper processing device to a downstream second paper processing device, the paper conveyor comprising:

a paper piling area where paper ejected from the first paper processing device is piled up;

a sensor provided in a conveyance path for conveying paper from the paper piling area to the second paper processing device, the sensor detecting that the paper has passed; and a control device, wherein the control device is configured to convey paper when a conveyance request signal is received, and wherein the control device is configured to transmit a paper passage signal when passage of the paper is detected by the sensor.

13. The paper conveyor according to claim 12, wherein the sensor detects passage of the paper when a front edge of the paper is detected in a conveying direction.

14. The paper conveyor according to claim 13, wherein the sensor is provided in a vicinity of an ejecting portion where paper is ejected from the paper piling area.

15. The paper conveyor according to claim 12, wherein the sensor is disposed in the paper conveyor.

16. A conveyance control device for controlling a paper conveyance request timing of a paper conveyor configured to convey paper ejected from an upstream first paper processing device to a downstream second paper processing device, the conveyance control device comprising:

a conveyance request unit configured to transmit a conveyance request signal to the paper conveyance device at a conveyance request timing corresponding to a processing cycle of the second paper processing device;

a passage information reception unit configured to receive a paper passage signal indicating that paper has been sent from the paper conveyor;

a determination unit configured to determine whether there is a conveyance delay based on a reception timing of the paper passage signal; and a timing correction unit configured to correct the conveyance request timing, wherein the conveyance request unit is configured to transmit the conveyance request signal at the conveyance request timing corresponding to the next processing cycle when it is determined that a conveyance delay has not occurred, wherein the conveyance request unit is configured not to transmit the conveyance request signal at the conveyance request timing corresponding to the next processing cycle when it is determined that a conveyance delay has occurred, wherein the timing correction unit is configured to be provided on the second paper processing device, and is configured to estimate an actual processing position of paper based on a timing when the paper has passed a paper detection position provided further upstream than a processing unit for performing processing, and wherein the timing correction unit is configured to correct the conveyance request timing based on a deviation amount between the estimated processing position and a preset reference processing position.

17. A conveyance control method for controlling a paper conveyance request timing of a paper conveyor configured to convey paper ejected from an upstream first paper processing device to a downstream second paper processing device, the method comprising:

transmitting a conveyance request signal to the paper conveyor at a conveyance request timing corresponding to a processing cycle of the second paper processing device;

receiving a paper passage signal indicating that paper has been sent from the paper conveyor;

determining whether there is a conveyance delay in the paper conveyor based on a reception timing of the paper passage signal; and transmitting the conveyance request signal at the conveyance request timing corresponding to the next processing cycle when it is determined that a conveyance delay has not occurred, and not transmitting the conveyance request signal at the conveyance request timing corresponding to the next processing cycle when it is determined that a conveyance delay has occurred.

* * * * *